US006823540B2

(12) United States Patent
Gunn

(10) Patent No.: US 6,823,540 B2
(45) Date of Patent: Nov. 30, 2004

(54) AUTOMATICALLY RELEASING BATHTUB OVERFLOW STOPPER

(76) Inventor: J. Jeffrey Gunn, 55-1/2 Haywood St., Suite 3C, Asheville, NC (US) 28801

( * ) Notice: Subject to any disclaimer, the term of this patent is extended or adjusted under 35 U.S.C. 154(b) by 0 days.

(21) Appl. No.: 10/806,757

(22) Filed: Mar. 22, 2004

(65) Prior Publication Data

US 2004/0163172 A1 Aug. 26, 2004

(51) Int. Cl.[7] ..... E03C 1/22; E03C 1/24
(52) U.S. Cl. ..... 4/680; 4/679
(58) Field of Search ..... 4/293, 295, 507, 4/679–682, 686, 694, 695

(56) References Cited

U.S. PATENT DOCUMENTS

| | | | | |
|---|---|---|---|---|
| 306,603 | A | 10/1884 | Gilbert | |
| 656,352 | A * | 8/1900 | Holmes | 4/293 |
| 1,598,162 | A | 8/1926 | Solomon | |
| 3,927,428 | A | 12/1975 | Jette et al. | |
| D305,455 | S | 1/1990 | Stairs, Jr. | |
| 5,025,509 | A | 6/1991 | Holt et al. | |
| D336,948 | S | 6/1993 | Frankel | |
| 6,216,288 | B1 | 4/2001 | Bernau | |
| 6,295,661 | B1 * | 10/2001 | Bromley | 4/507 |
| 2002/0162169 | A1 | 11/2002 | Bouchard | |

OTHER PUBLICATIONS

Miles Kimball web page "Deep Water Bath Control" http://www.mileskimball.com/jump.jsp?itemType=PRODUCT&iProductID=7118 (downloaded from Internet Mar. 16, 2004; effective date unknown).

Deep Water Bath product packaging; ©2002 Better Sleep, Inc., 80 Industrial Rd., Berkeley Heights, NJ 07922.

* cited by examiner

*Primary Examiner*—Tuan Nguyen
(74) *Attorney, Agent, or Firm*—Schemiser Olsen & Watts, LLP

(57) ABSTRACT

A device for blocking or impeding the flow of water through the overflow drain of a bathtub of the type including a wall, an overflow drain opening in the wall, and a generally circular cover plate over the overflow drain opening, the cover plate having an annular skirt with at least one overflow opening in the annular skirt at the bottom of the cover plate. The device takes the form of a stopper including an arcuate surface configured so as to cover the overflow opening. The stopper is made of a material and is configured so as to be held in place, when water level in the bathtub is above the overflow opening, by water pressure or buoyancy only. As a result, the stopper, once held in place, falls away from the overflow opening when water level in the bathtub subsequently drops below the cover plate.

9 Claims, 4 Drawing Sheets

AUTOMATICALLY RELEASING BATHTUB OVERFLOW STOPPER

BACKGROUND OF THE INVENTION

The invention relates generally to bathtub overflows and, more particularly, to a device for blocking or impeding the flow of water through the overflow drain of a bathtub.

Typical bathtubs include an overflow drain which takes the form of a drain opening in a wall of the bathtub, and a generally circular cover plate over the drain opening. The cover plate has an annular skirt axially projecting from the perimeter of the cover plate towards the bathtub wall. At the bottom of the cover plate are one or two overflow openings which limit the water level in the tub.

Some persons prefer to take a bath in a nearly-full tub, with the water level above the overflow openings, and accordingly desire to block the overflow drain.

SUMMARY OF THE INVENTION

In one aspect, the invention is embodied in a device for blocking or impeding the flow of water through the overflow drain of a bathtub of the type including a wall, a drain opening in the wall, and a generally circular cover plate over the drain opening, the cover plate having an annular skirt with at least one overflow opening in the annular skirt at the bottom of the cover plate. The device takes the form of a stopper including an arcuate surface configured so as to cover the overflow opening. The stopper is made of a material and is configured so as to be held in place, "when water" level in the bathtub is above the overflow opening, by water pressure or buoyancy only. As a result, the stopper, once held in place, falls away from the cover plate and from the overflow opening when water level in the tub subsequently drops below the cover plate.

In another aspect, the invention is embodied in a method for blocking or impeding the flow of water through the overflow drain of a bathtub of the type summarized just above. The method includes the step of employing a stopper as summarized just above.

DETAILED DESCRIPTION

Figure 1:
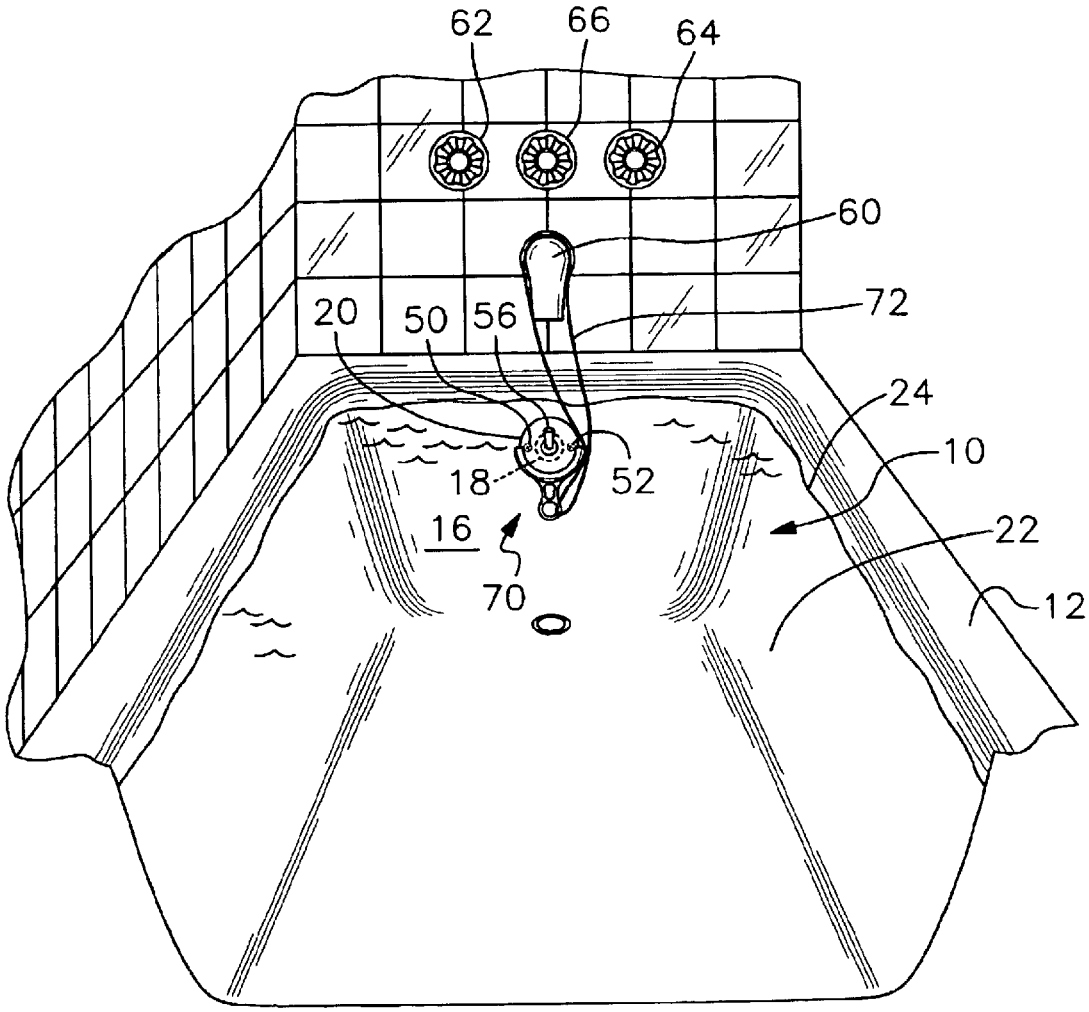
FIG. 1 shows a device embodying the invention in use blocking the overflow drain of a bathtub.
Figure 2:
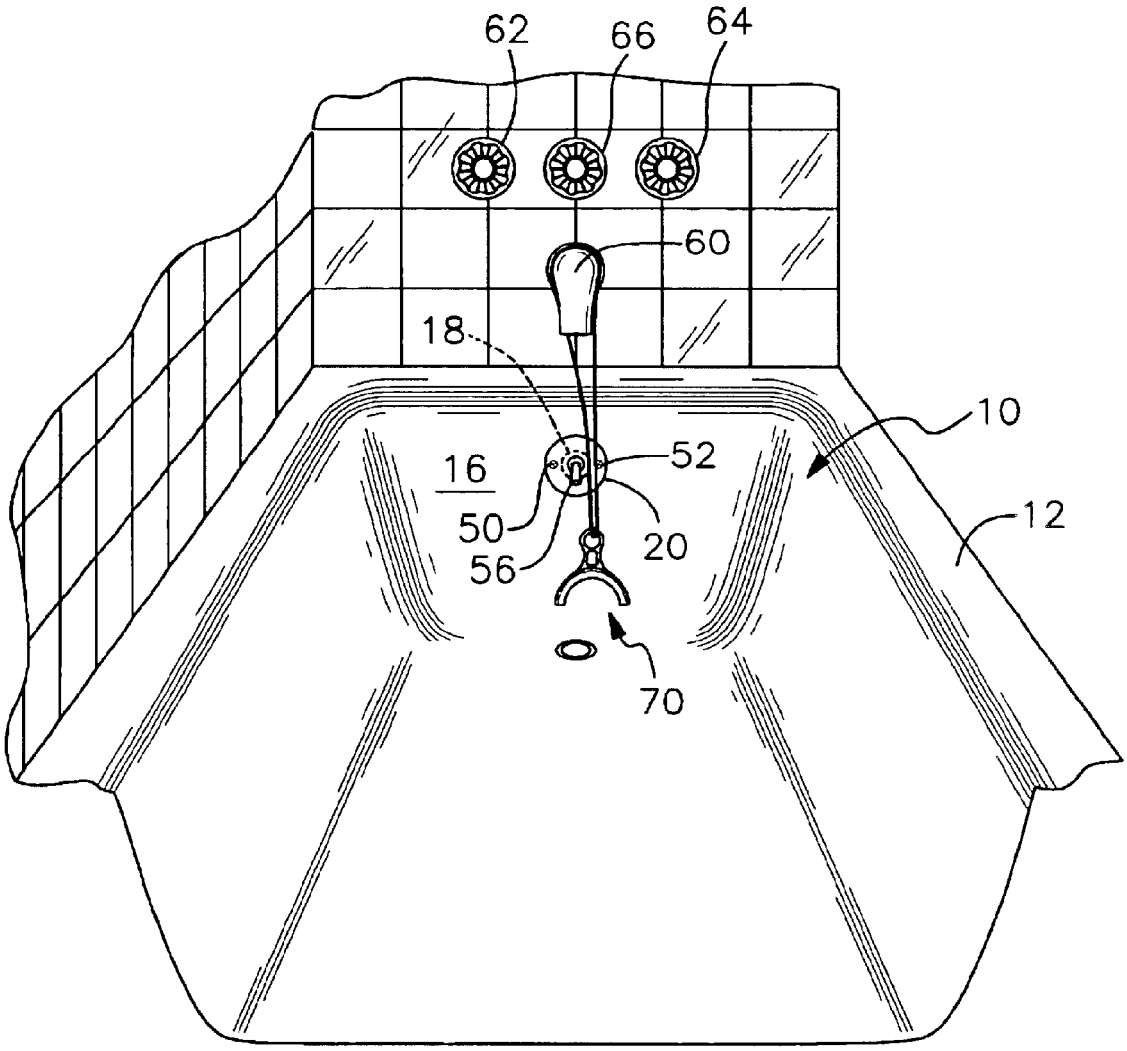
FIG. 2 is a view illustrating the situation when the bathtub has subsequently been drained.

Referring first to FIGS. 1 and 2, a bathtub 10 includes a top rim 12, a bottom 14, and an end wall 16. An overflow drain opening 18 in the end wall 16 is shown in dash lines. Over the drain opening 18 is a generally circular cover plate 20. The cover plate 20 is attached to a circular mounting plate (not shown). In FIG. 1, the bathtub 10 is filled with water 22 to a water level 24 above the drain opening 18 and above the cover plate 20, as is described in detail hereinbelow. In FIG. 2, the bathtub 10 is empty.

Figure 3:
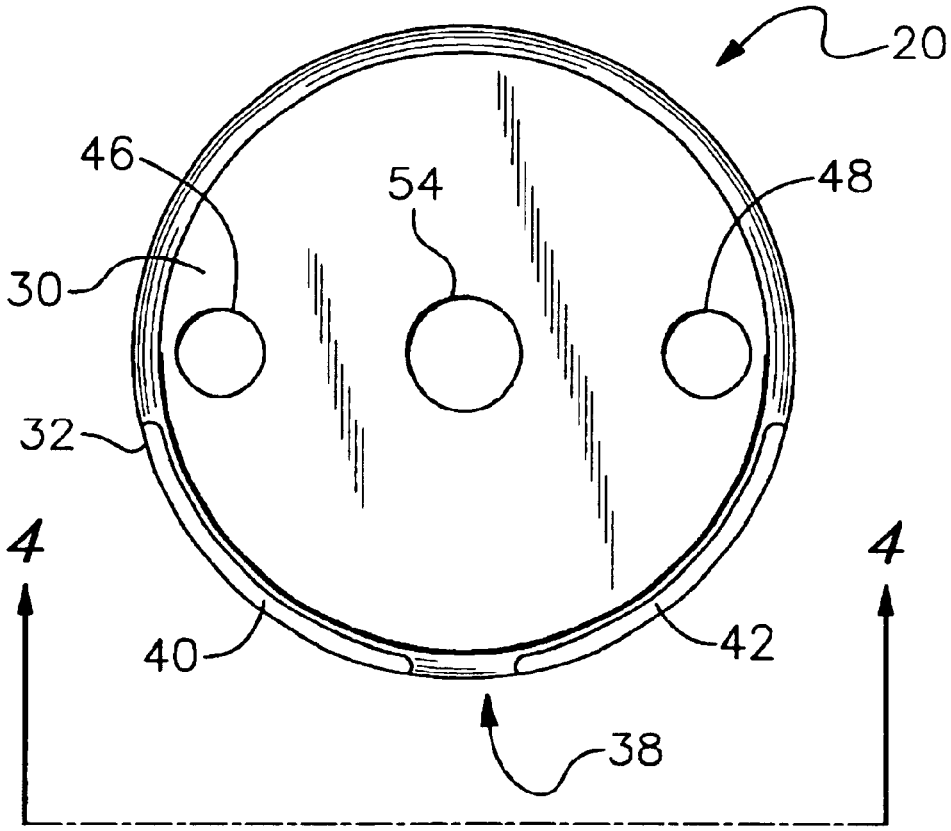
FIG. 3 is a front elevational view of the cover plate over the overflow drain opening in isolation, greatly enlarged with reference to the same cover plate visible in FIGS. 1 and 2.
Figure 4:
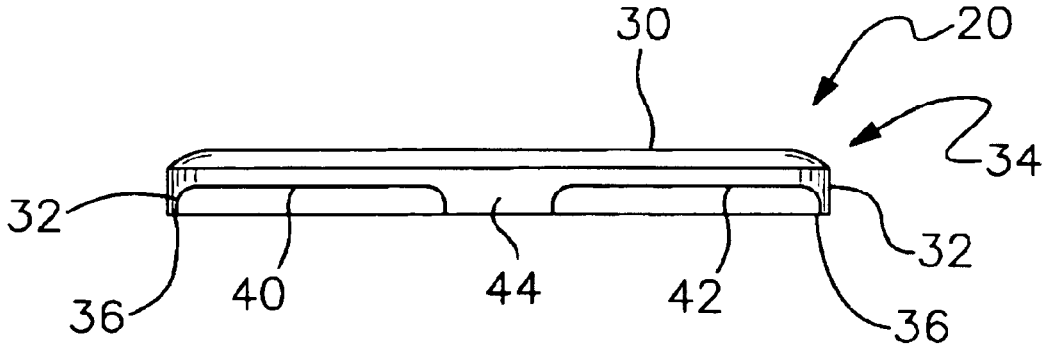
FIG. 4 is a bottom plan view of the cover plate, taken on line 4–4 of FIG. 3.

Referring to FIGS. 3 and 4, which are enlarged front elevational and bottom plan views, respectively, of the cover plate 20 in isolation, the cover plate 20 has a circular front portion 30, and an annular skirt 32 which axially projects from the perimeter 34 of the cover plate 20, towards the end wall 16 of the bathtub 10 when installed as shown in FIGS. 1 and 2. When installed, an edge of the cover plate 20 contacts either the bathtub end wall 16 or the circular mounting plate (not shown).

At the bottom 38 of the cover plate 20 there are a pair of overflow openings 40 and 42 or cutouts 40 and 42 in the annular skirt 32 through which bathtub overflow water enters the space behind the cover plate 20 and the drain opening 18. The cutouts 40 and 42 are separated by an intermediate skirt portion 44. The cover plate 20 additionally includes a pair of apertures 46 and 48 for attachment screws 50 and 52 (FIGS. 1 and 2), as well as a central aperture 54 for a drain toggle 56 (FIGS. 1 and 2).

Also visible in FIGS. 1 and 2 and associated with the bathtub 10 are a water supply spout 60, hot and cold water faucet handles 62 and 64, as well as an intermediate shower diverter valve handle 66.

In FIG. 1, a device 70 embodying the invention is blocking or at least impeding the flow of water through the overflow drain of the bathtub 10, in particular is blocking the overflow openings or cutouts 40 and 42 in the annular skirt 32 of the cover plate 20. The water level 24 is above the level of the overflow openings or cutouts 40 and 42, and above the level of the actual drain opening 18.

FIG. 2 illustrates the situation when the water 22 (FIG. 1) has been drained from the bathtub 10, and the device 70 has fallen away from the cover plate 20, more particularly away from the overflow openings or cutouts 40 and 42. However, the device 70 is conveniently retained by a tether 72 looped around a convenient point, in this particular example, the spout 60.

Figure 5:
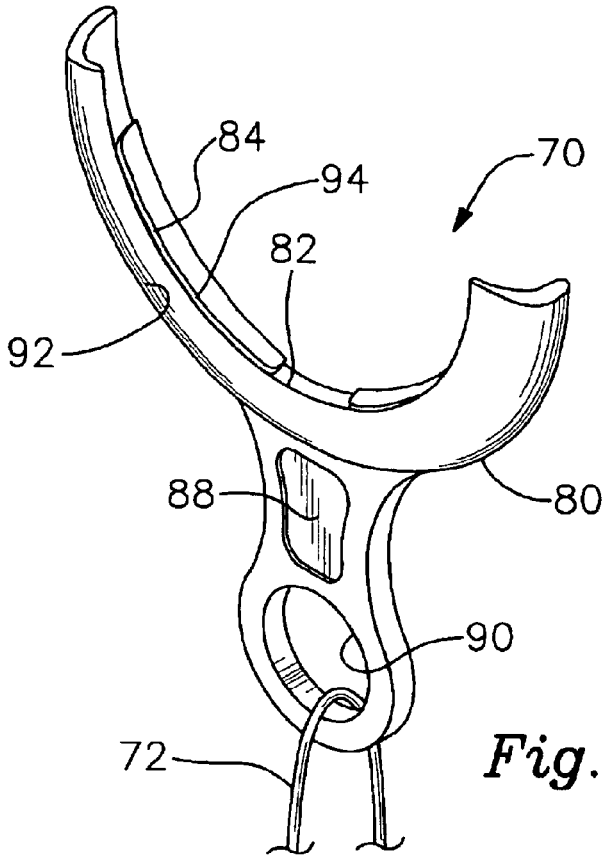
FIG. 5 is an enlarged three-dimensional view of the device embodying the invention.
Figure 6:
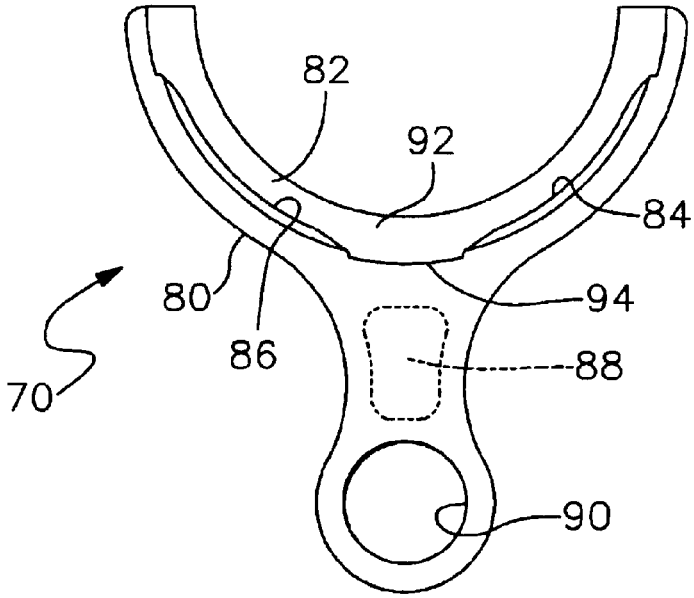
FIG. 6 is a rear elevational view of the device.

Referring finally to FIGS. 5 and 6, the device 70 more particularly comprises a stopper 70 which, in the illustrated embodiment, has a semi-circular body 80 which includes an arcuate and generally concave surface 82 configured so as to cover the overflow openings 40 and 42. Projecting from the arcuate surface 80 are a pair of locating bosses 84 and 86 which are sized so as to fit within the overflow openings 40 and 42, respectively. The stopper 70 has a handle 88 attached to an outside portion of the semi-circular body 80, opposite the arcuate surface 82, and terminating in an aperture 90 for attachment of the tether 72. The stopper 70 is made from a soft pliable rubber or rubber-like material, such as a vinyl, and has a neutral or slightly positive buoyancy in water.

It is significant that the locating bosses 84 and 86 function as locating bosses only, and do not fit tightly within the overflow openings 40 and 42. In other words, the locating bosses 84 and 86 are not intended to provide frictional engagement.

The stopper 70 additionally includes edges 92 and 94 which typically contact the cover plate 20 to block or impede the flow of water through the overflow drain, aided by the pliable nature of the stopper 70 material. Thus, depending on the precise shape of the cover plate 20 and the cutouts 40 and 42, at least a partial seal is formed between contacting portions of the concave arcuate surface 82 and the edges 92 and 94, on the one hand, and portions of the cover plate 20, on the other hand. As a result, the flow of water through the cutouts 40 and 42 and then through the drain opening 18 is either blocked or greatly impeded.

A significant characteristic of the stopper 70 is that when the water level 24 in the bathtub 10 is above the overflow openings 40 and 42, the stopper 70, as a result of the material of which it is made and its configuration, is held in place by water pressure or buoyancy only. In other words, any frictional engagement which may exist is insufficient to hold the stopper 70 in place without the water 22.

As a result, when the bathtub 10 is being filled with water 22, the stopper 70 must be deliberately employed at the time when the water level 24 just reaches the height of the overflow openings 40 and 42. This prevents a person from applying the stopper 70 to block the overflow openings 40 and 42 while beginning to fill the bathtub 10 with water 22, with the intention of returning to shut off the flow of water 22 into the bathtub before the bathtub 10 overflows. Many persons do other tasks while a bathtub 10 is filling, at least in the initial stages, and accordingly do not simply watch the bathtub 10 during the initial stages of a filling operation. If a person is distracted while the bathtub 10 is filling and if the stopper 70 were to be in place, the bathtub 10 could very well overflow.

Accordingly, during use, when the water level 24 reaches the overflow openings 40 and 42 during a filling operation, the person filling the bathtub positions the stopper 70 as illustrated in FIG. 1 so as to block the overflow openings 40 and 42. At that point, one possibility is that the person manually holds the stopper 70 in place for a minute or two until such time as the water level 24 has sufficiently risen to hold the stopper 70 in place. Alternatively, the person at that point may simply turn off the flow of water 22 into the bathtub 10 and enter the bathtub 10. Water displaced by the person's body causes the water level 24 to rise sufficiently so that the stopper 70 is immediately held in place by water 22 in the bathtub 10. In either event water pressure, buoyancy, or a combination thereof holds the stopper 70 in place.

Also in either event, at the time the overflow openings 40 and 42 are blocked, a person is present to ensure that the bathtub 10 does not overflow.

As illustrated in FIG. 2, when the water level 24 in the bathtub 10 subsequently drops below the cover plate 20, the stopper 70 falls away from the cover plate 20 and from the overflow openings 40 and 42, thus ensuring that the stopper 70 must again be manually applied, as described just above, the next time the bathtub 10 is filled. Accordingly, the stopper 70 can be characterized as "automatically releasing."

While a specific embodiment of the invention has been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A device for blocking or impeding the flow of water through the overflow drain of a bathtub of the type including a wall, an overflow drain opening in the wall, and a generally circular cover plate over the overflow drain opening, the cover plate having an annular skirt with at least one overflow opening in the annular skirt at the bottom of the cover plate, said device comprising:

a stopper including an arcuate surface configured so as to cover the overflow opening and a locating boss projecting from said arcuate surface and sized so as to fit within the overflow opening, said stopper being made of a material and configured so as to be held in place, when water level in the bathtub is above the overflow opening, by water pressure or buoyancy only;

whereby said stopper, once held in place, falls away from the overflow opening when water level in the bathtub subsequently drops below the cover plate.

2. The device of claim 1, which is for blocking the overflow drain of a bathtub wherein the cover plate has a pair of overflow openings in the annular skirt separated by an intermediate wall; wherein said stopper includes a pair of locating bosses projecting from said arcuate surface and sized so as to fit within the overflow openings, respectively.

3. The device of claim 2, wherein said stopper includes a tether attachment aperture.

4. The device of claim 1, wherein said stopper includes a tether attachment aperture.

5. The device of claim 1, wherein said stopper comprises vinyl.

6. The device of claim 1, wherein said stopper is made of a material which has substantially neutral buoyancy in water.

7. The device of claim 1, wherein said stopper is made of a material which has a positive buoyancy in water.

8. A method for blocking or impeding the flow of water through the overflow drain of a bathtub of the type including a wall, a drain opening in the wall, and a generally circular cover plate over the drain opening, the cover plate having an annular skirt with at least one overflow opening at the bottom of the cover plate, said method comprising:

employing a stopper which includes an arcuate surface configured so as to cover the overflow opening, and a locating boss projecting from said arcuate surface and sized so as to fit within the overflow opening; said stopper which is made of a material and configured so as to be held in place, when water level in the bathtub is above the overflow opening, by water pressure or buoyancy only, whereby the stopper, once held in place, falls away from the overflow opening when water level in the bathtub subsequently drops below the cover plate.

9. The method of claim 8, which further comprises tethering the stopper.

* * * * *